US011987760B2

(12) United States Patent
Unsworth et al.

(10) Patent No.: US 11,987,760 B2
(45) Date of Patent: May 21, 2024

(54) PROCESSES FOR UTILISATION OF PURIFIED COAL TO UPGRADE REFINERY PROCESS COMPONENTS IN THE MANUFACTURE OF PETROLEUM COKE

(71) Applicant: Arq IP Limited, London (GB)

(72) Inventors: John Unsworth, London (GB); Stephen Paspek, Broadview Heights, OH (US)

(73) Assignee: Arq IP Limited, London (GB)

( * ) Notice: Subject to any disclaimer, the term of this patent is extended or adjusted under 35 U.S.C. 154(b) by 227 days.

(21) Appl. No.: 17/609,561

(22) PCT Filed: May 8, 2020

(86) PCT No.: PCT/US2020/032050
§ 371 (c)(1),
(2) Date: Nov. 8, 2021

(87) PCT Pub. No.: WO2020/227613
PCT Pub. Date: Nov. 12, 2020

(65) Prior Publication Data

US 2022/0213390 A1 Jul. 7, 2022

(30) Foreign Application Priority Data

May 9, 2019 (GB) ..... 1906563
May 24, 2019 (GB) ..... 1907378

(51) Int. Cl.
*C10G 9/00* (2006.01)
*C10B 53/04* (2006.01)
(Continued)

(52) U.S. Cl.
CPC ..... *C10G 9/005* (2013.01); *C10B 53/04* (2013.01); *C10B 55/10* (2013.01); *C10B 57/045* (2013.01);
(Continued)

(58) Field of Classification Search
CPC ..... C10G 9/005; C10G 2300/1077; C10G 2300/202; C10G 2300/205;
(Continued)

(56) References Cited

U.S. PATENT DOCUMENTS 4,259,178 A 3/1981 Wynne, Jr. et al.
4,427,532 A 1/1984 Varghese
(Continued)

FOREIGN PATENT DOCUMENTS

CN 109504416 A 3/2019
GB 866859 A 5/1961
(Continued)

OTHER PUBLICATIONS

Indonesian Office Action pertaining to Application No. P00202111049 dated Jun. 5, 2023.
(Continued)

*Primary Examiner* — Ellen M McAvoy
(74) *Attorney, Agent, or Firm* — Dinsmore & Shohl LLP

(57) ABSTRACT

Processes for the production of coke, and one or more volatile products comprise the steps of: (i) providing a purified coal product (PCP), wherein the PCP is in particulate form, and wherein at least about 90% v of the particles are no greater than about 100 μm in diameter; wherein the PCP has an ash content of less than about 10% m and a water content of less than around 5% m; (ii) combining the PCP with a liquid residue oil to create a combined solid-liquid blend, wherein the solid-liquid blend comprises at least around 0.1% m and at most around 30% m PCP; (iii) subjecting the solid-liquid blend to a temperature in excess of 375° C. for a time period sufficient to induce cracking of at least 1% of the PCP particles to generate the one or more volatile products, and (iv) producing coke from the product of step (iii).

19 Claims, 6 Drawing Sheets

(51) Int. Cl.
*C10B 55/10* (2006.01)
*C10B 57/04* (2006.01)

(52) U.S. Cl.
CPC ..... *C10G 2300/1077* (2013.01); *C10G 2300/202* (2013.01); *C10G 2300/205* (2013.01); *C10G 2300/206* (2013.01); *C10G 2300/302* (2013.01); *C10G 2300/304* (2013.01); *C10G 2300/308* (2013.01)

(58) Field of Classification Search
CPC ..... C10G 2300/206; C10G 2300/302; C10G 2300/304; C10G 2300/308; C10B 53/04; C10B 55/10; C10B 57/045
See application file for complete search history.

(56) References Cited

U.S. PATENT DOCUMENTS

| | | | | |
|---|---|---|---|---|
| 4,943,367 | A | 7/1990 | Nixon et al. | |
| 5,658,455 | A | 8/1997 | Hammond et al. | |
| 9,777,235 | B2 | 10/2017 | Snaith et al. | |
| 2005/0279673 | A1 | 12/2005 | Eppig et al. | |
| 2008/0156700 | A1* | 7/2008 | Abulnaga | C10G 21/003 208/251 R |
| 2008/0256852 | A1 | 10/2008 | Schobert | |
| 2012/0076703 | A1 | 3/2012 | Stiller et al. | |
| 2015/0162600 | A1 | 6/2015 | Wakizaka et al. | |
| 2015/0184099 | A1 | 7/2015 | Swensen et al. | |
| 2015/0361370 | A1* | 12/2015 | Van Thorre | C10L 5/447 44/589 |
| 2017/0096340 | A1* | 4/2017 | Wada | C04B 35/532 |
| 2018/0258350 | A1 | 9/2018 | Snaith et al. | |
| 2019/0031961 | A1 | 1/2019 | Ottinger et al. | |

FOREIGN PATENT DOCUMENTS

| | | | |
|---|---|---|---|
| WO | 2009137437 | A1 | 11/2009 |
| WO | 2016093000 | A1 | 6/2016 |
| WO | 2017174973 | A1 | 10/2017 |
| WO | 2020065341 | A1 | 4/2020 |

OTHER PUBLICATIONS

European Search Report pertaining to Application No. 20802931.4 dated Apr. 20, 2023, 12 pages.
International Search Report & Written Opinion to corresponding PCT Application No. PCT/US2020/032050 dated Jul. 23, 2020.
Patents Act 1977: Search Report under Section 17(5) corresponding to GB Application No. 1906563.0 dated Oct. 28, 2019.
Muzenda, E., "Potential uses of South African Coal Fines: A Review", 3rd International Conference on Mechanical, Electronics and Mechatronics Engineering (ICMEME'2014), Mar. 19-20, 2014, p. 37-39, Abu Dhabi (UAE).
Baruya, P., "Losses in the coal supply chain", IEA Clean Coal Centre Rep. CCC/212, Dec. 2012, p. 1-66, ISBN 978-92-9029-532-7.
Burgess Clifford, et al., C., "Production of Coal-Based Fuels and Value-Added Products: Coal to Liquids Using Petroleum Refinery Streams", CAER—University of Kentucky, Center for Applied Energy Research Energeia, Jul. 2008, p. 1-6, vol. 19, No. 1.
Singapore Written Opinion pertaining to Application No. 11202112213T dated Feb. 27, 2023, 7 pages.

* cited by examiner (a) (b) (c)

PROCESSES FOR UTILISATION OF PURIFIED COAL TO UPGRADE REFINERY PROCESS COMPONENTS IN THE MANUFACTURE OF PETROLEUM COKE

CROSS-REFERENCE TO RELATED APPLICATIONS

This application is a National Stage Entry under 35 U.S.C. § 371 of International Patent Application No. PCT/US2020/032050, filed May 8, 2020, which claims priority to United Kingdom Patent Application No. 1906563.0, filed on May 9, 2019, and United Kingdom Patent Application No. 1907378.2, filed May 24, 2019, both of which are incorporated herein by reference in their entireties.

FIELD OF THE INVENTION

The invention is in the field of processing and utilisation of solid hydrocarbons, most particularly coal. In particular the invention is in the field of remediation and exploitation of waste coal fines derived from mineral extraction and mining activities and the production of coke.

BACKGROUND OF THE INVENTION

Coal fines and ultrafines, including microtines, are the small particles of coal generated from larger lumps of coal during the mining and preparation process. While coal fines retain the same energy and resource potential of coal they are generally considered a waste product as the particulate nature of the product renders it difficult to market and transport. As much as 70-90 million tonnes of coal fines are produced in the US alone as waste by-product every year by the mining industry (Baruya, P., Losses in the coal supply chain, IEA Clean Coal Centre Rep.CCC/212, p. 26, December 2012, ISBN 978-92-9029-532-7), the vast majority of which is left unused. Coal fines are therefore generally discarded as spoil close to the colliery forming large waste heaps or contained in large ponds that require careful future management in order to avoid environmental contamination.

In its natural state, coal fines typically contain significant levels of ash-forming components and a high water content that renders it unsuitable for many conventional uses. The traditional view has been that the cost of dewatering and/or drying as well as de-ashing fines that are <150 μm in diameter generally exceeds the actual value of the resultant product (Muzenda, E., Potential uses of South African Coal Fines: A Review, 3rd International Conference on Mechanical, Electronics and Mechatronics Engineering (ICMEME'2014, Mar. 19-20, 2014 Abu Dhabi (UAE), p. 37). It is known to add highly processed coal fines to fuel oils in order to reduce the cost per unit volume of the resultant blended fuel oil (see for example U.S. Pat. No. 9,777,235). In addition, highly processed coal fines can be added to crude oil in order to contribute to the fractionation products following distillation (see International Patent Application Published as WO2017/174973). In both instances the coal fines are blended with a liquid hydrocarbon to create a resultant admixture with enhanced perceived commercial value greater than that of the solid fines alone.

Coke is classed as a fossil fuel and is a non-renewable energy source. Traditionally, coke has been produced by the destructive distillation of coal in coke ovens. In this process, coal is heated in an oxygen-free atmosphere (i.e. coked) until most volatile components in the coal are driven off. The material remaining is a solid carbon mass called coke. As the popularity of coal has declined, in more recent times coke has been increasingly obtained from residue oil by destructive distillation (thermal cracking) in for example a delayed or fluidised coking process. Coke produced by these processes is typically referred to as 'Pet-coke'. Furthermore, similarly to oil refining, volatile products that are obtained from a delayed coking process are always significantly more valuable than the residual oil feed starting material. A way in which residual oil feedstocks could be blended with a cheaper starting material to extend the finite reserves of hydrocarbon-containing mineral resources, and the resultant refined distillate products, would be highly desirable.

Delayed cokers are integral parts of the oil refining process in that they contribute to the upgrading of heavy residue fractions obtained from earlier crude oil distillation/catalytic cracking processes into distillate fractions and petroleum coke, a carbon-rich solid material. The recovered distillate is utilised to make additional naphtha, kero and gas oil streams within the refinery. Pet-coke is used, either as a fuel or, if low in sulfur and metals, as a higher value anode grade in aluminium and titanium oxide manufacturing.

An alternative to a delayed coker is the fluid coker, wherein the feedstock is pyrolyzed on the surface of hot fluidized coke particles. The feedstock is sprayed into a bed of fluidized hot petroleum coke particles in a first vessel. Volatiles are released, separated from the coke particles, and collected for further processing. The fluidized coke particles, now with additional coke burden from the pyrolyzed feedstock, are sent to a second vessel, where they are partially combusted to increase their temperature. A portion of these hot coke particles are returned to the first vessel to continue the cycle, while the balance of the coke particles is withdrawn and used for other purposes, such as feedstock to a gasifier unit.

U.S. Pat. No. 4,259,178 relates to a process for carbonaceous coke. A carbonaceous coke is manufactured by the delayed coking of a slurry mixture of from about 10 to about 30 weight percent of caking or non-caking coal having a proximate analysis by-weight of about of 32.7% volatiles, 7.2% moisture, 44.8% fixed carbon and 15.3% ash; with about 90 to 70% by-weight petroleum processing residue having a weight composition of about 51% aromatics, 19.3% saturates, 25.2% polar compounds and 4.5% asphaltenes with a specific gravity of about 1.006 at a mixing temperature of 50°–65° C. The coke produced has very specific properties and is described as softer, more friable, more porous than conventional metallurgical or foundry coke.

U.S. Pat. No. 4,427,532, relates to a process for producing coking coal. A hydrotreated petroleum residuum is coked in the presence of coal to improve the yield and quality of the liquid coker products. The coal is suitably of low rank with a carbon content below 75 weight percent with best results being obtained with sub-bituminous coals. It is proposed that it is the oxygen content of the coal which leads to the scavenging of the heteroatoms such as nitrogen and sulfur from the residuum and for this reason, the oxygen content of the coal is significant in making the selection among the types of coals which are deemed suitable for use in the described process.

U.S. Pat. No. 4,943,367 relates to a process for the production of high purity coke from coal that has been beneficiated to an ash content not exceeding 20%. High purity coke particularly suited to the production of anodes for aluminium smelting is produced by an integrated process that includes flash pyrolysis and delayed coking. In the integrated process, flash pyrolysis of carbonaceous materials such as coal, oil shale or tar sand is operated under conditions that maximize the production of a liquid tar suitable for subsequent use in a delayed coker.

U.S. Pat. No. 4,259,178 describes a process for manufacturing carbonaceous coke by the delayed coking of a slurry mixture of from about 10 to about 30 weight percent of caking or non-caking coal and the remainder a petroleum residue blended at below 50° C. The parameters of the coal used such as particle size and distribution, ash and water content are not disclosed in any detail.

Chinese Patent Application No. 109504416 relates to production technologies of coal-based needle coke using coal oil mixtures. The document describes coal-based needle coke having a D50 between 20-50 mm.

United Kingdom Patent No. 866,859 relates to a process for the production of petroleum coke suitable for conversion into graphite for nuclear reactors and involves treating a hydrocarbon material consisting of a petroleum distillate by physical treatment and/or chemical reaction with oxygen at a temperature in the range 175 to 400° C., and subjecting the resultant product to a thermal cracking treatment under such conditions that petroleum coke is formed.

In Burgess & Schobert (Energeia Vol. 19, No. 1, 2008) a process is described for the production of jet fuel and high-quality carbon from delayed coking of blended ultra-clean seam coal and decant oil. The sponge coke produced was not of sufficient quality to meet specifications for aluminium-smelting anodes due to excess iron and silicone content.

The present invention addresses the problems that exist in the prior art, not least in reducing the further accumulation of waste fines as a by-product of the coal mining industry and improving throughput of a delayed coker by providing alternative feedstock external from the refinery.

SUMMARY OF THE INVENTION

The invention relates to the addition of a Purified Coal Product (PCP, a form of microfine coal) to conventional and non-conventional coker feed-stock, which can be introduced by blending with a hydrocarbonaceous liquid component prior to thermal pre-treatment in a delayed coker, fluid coker, or flexi-coker. Such blends enable the production from a coal-based feedstock of distillate material and petroleum coke (Pet-coke) formed at the cracking temperatures in the preheater and coke drums. By doing this, the utilisation of a delayed coker, fluid or flexi-coker can be increased substantially by providing alternative feedstock external from the refinery, and the flexibility of refinery operations is increased by freeing up residue for other uses.

The present inventors have developed a process that provides for the utilisation of very high quality (low ash, sulphur and water content) Purified Coal Product (PCP), that have been upgraded from waste from coal tailings ponds, impoundments or tips and reject materials from current coal production processing (e.g. thickener underflow or tailings underflow waste streams), as well as high-ash content inferior seam coal, hitherto not exploitable economically, or production run of mine coal in the following exemplary non-limiting application: blending with a hydrocarbonaceous liquid component, such as a residue oil, prior to thermal pre-treatment in a delayed coker to obtain coke and valuable volatiles in a delayed coking process.

A first aspect of the invention provides a process for the production of coke comprising the steps of:

(i) providing a purified coal product (PCP), wherein the PCP is in particulate form, and wherein at least about 90% by volume (% v) of the particles are no greater than about 75 μm in diameter; wherein the PCP has an ash content of less than about 10% m and a water content of less than around 5% m;

(ii) combining the PCP with an oil in order to create a combined solid-liquid blend, wherein the solid-liquid blend comprises at least around 0.1% m and at most around 30% m PCP;

(iii) subjecting the solid-liquid blend to a temperature in excess of 375° C. for a time period sufficient to induce cracking of at least 1% of the PCP particles to generate one or more volatile distillate products, and (iv) producing coke from the product of step (iii).

Various conventional coking processes may be used to implement the aspects and embodiments of the present invention including delayed coking, fluid coking and flexi-coking. Some embodiments of the invention are described below with reference to a delayed coking process but the same considerations will, in general, apply to the other mentioned coking processes also.

In a specific embodiment of the invention, at least about 90% by volume (% v) of the PCP particles are no greater than about 50 μm in diameter; optionally no greater than about 20 μm in diameter. Typically, the PCP has an ash content of less than about 2% m, suitably less than about 1.5% m, optionally no more than 1% m. Suitably, the PCP has a water content of less than around 2% m.

In embodiments of the invention the oil comprises one or more of the group consisting of: a residue from refinery atmospheric distillation of crude oil feedstock; a residue from vacuum distillation of crude oil feedstock; slurry oil from catalytic crackers; bottoms from naphtha crackers; oil produced by pyrolysis of coal, plastics, wood and biomass; black liquor from the Kraft process of wood pulp manufacture; light and heavy cycle oil; light and heavy gas oil; diesel fuel; fuel oil; bunker oil; boiler fuel oil; marine fuel oil; marine diesel oil; biodiesel; slop oil; oil derived from tar sands; fluid catalytic cracking (FCC) decanted (decant) oil; crude oil; topped crude oil; synthetic crude oil (such as those produced in Canada); any derivatives of crude oil; and lower viscosity oil from biofuel manufacture.

According to yet a further embodiment the solid-liquid blend of (iii) is used as a feedstock in a delayed coker in step (iv). Optionally, the feedstock may be preheated before introduction into the coker fired heater via heat exchange with other suitable streams. Suitably, the feedstock is introduced into a drum of a delayed coker. Typically, the feedstock is heated, such as in a fired heater, to a temperature of at least 450° C. Optionally, step (iii) further comprises a fractionation step. In a specific embodiment, the process further comprises a step of calcining the coke of step (iv) in order to produce a calcined coke.

A second aspect of the invention provides a process for operating a delayed, fluid or flexi coker comprising performing the process as described herein in the delayed, fluid or flexi coker.

A third aspect provides a coke product obtainable by the process as described herein. Suitably the coke is prepared from a solid-liquid blend that comprises at least around 5% m and at most around 30% m PCP, optionally at least around 10% m and at most around 20% m PCP. In one embodiment the coke is prepared from a solid-liquid blend that comprises a vacuum residue oil or fluid catalytic cracking (FCC) decanted oil. Suitably the coke is selected from the group consisting of: fuel grade coke; anode grade coke; needle coke; and battery coke.

A fourth aspect of the invention provides a calcined coke product obtainable by the process as described herein.

A fifth aspect of the invention provides a carbon anode comprising the calcined coke product as described herein.

A sixth aspect of the invention provides a distillate hydrocarbon liquid product obtainable by the process as described herein.

A seventh aspect of the invention provides a process for enhancing production of liquid volatile fractions within a delayed coker process comprising adding to a liquid oil feed stream a purified coal product (PCP), wherein the PCP is in particulate form, and wherein at least about 90% by volume (% v) of the particles are no greater than about 75 μm in diameter; wherein the PCP has an ash content of less than about 10% m and a water content of less than around 5% m.

An eighth aspect of the invention provides for the use of a purified coal product (PCP), wherein the PCP is in particulate form, and wherein at least about 90% by volume (% v) of the particles are no greater than about 75 μm in diameter; wherein the PCP has an ash content of less than about 10% m and a water content of less than around 5% m, as an additive in a delayed coker process in order to increase the proportion of liquid volatile products produced by the process. In one embodiment of the invention the use results in a reduction in the proportion of gaseous volatile products from the delayed coker process. In a further embodiment the use results in a conversion of gaseous volatile products from the delayed coker process into liquid volatile products.

It will be appreciated that the invention may be subjected to further combinations of the features disclosed herein but which are not explicitly recited above.

DRAWINGS

The invention is further illustrated by reference to the accompanying drawings in which.

DETAILED DESCRIPTION OF THE INVENTION

Figure 1:
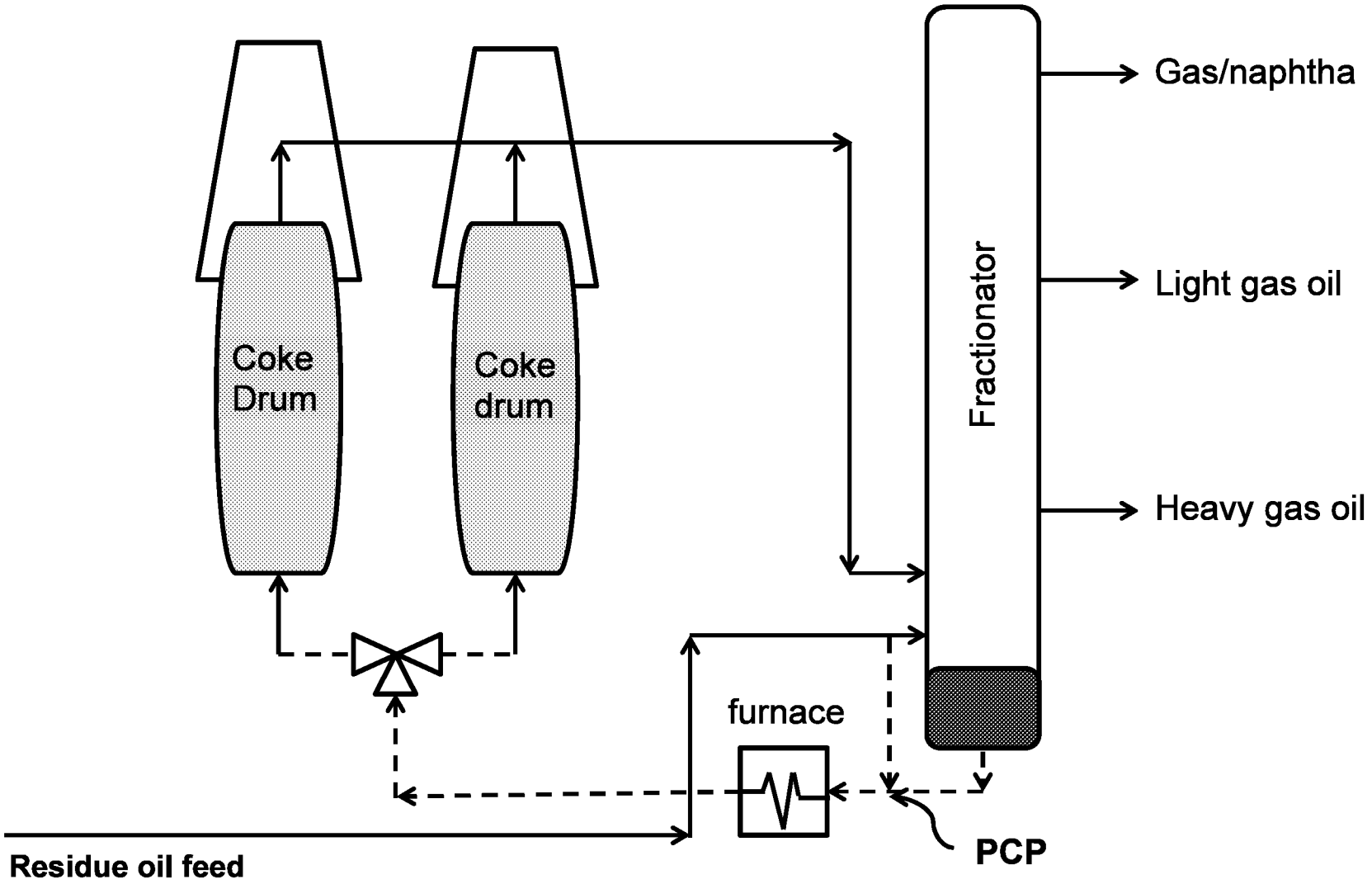
FIG. 1 shows a delayed coker schematic diagram.

All references cited herein are incorporated by reference in their entirety. Unless otherwise defined, all technical and scientific terms used herein have the same meaning as commonly understood by one of ordinary skill in the art to which this invention belongs.

Prior to setting forth the invention in greater detail, a number of definitions are provided that will assist in the understanding of the invention.

As used herein, the term "comprising" means any of the recited elements are necessarily included and other elements may optionally be included as well. "Consisting essentially of" means any recited elements are necessarily included, elements that would materially affect the basic and novel characteristics of the listed elements are excluded, and other elements may optionally be included. "Consisting of" means that all elements other than those listed are excluded. Embodiments defined by each of these terms are within the scope of this invention.

The term "coal" is used herein to denote readily combustible sedimentary mineral-derived solid hydrocarbonaceous material including, but not limited to, hard coal, such as anthracite; bituminous coal; sub-bituminous coal; and brown coal including lignite (as defined in ISO 11760:2005). "Native" or "feedstock" coal refers coal that has not been subjected to extensive processing and comprises a physical composition (e.g. maceral content) that is substantially unchanged from the point of extraction. In contrast, the terms "Purified Coal Product (PCP)", "coal-derived product", "coal replacement product" and "purified coal compositions" are used herein to refer to various coals which have been subjected to one or more processes that lead to a change in physical and/or chemical compositions of the coal such that it is substantially changed from the point of extraction—i.e. the natural state.

Petroleum coke (Pet coke or Pet-coke) is a solid by-product of the petroleum refining process. Typically formed using the delayed coker process, it is classified as either fuel grade Pet-coke or anode grade Pet-coke. Accounting for more than three quarters of global production, fuel grade Pet-coke is utilised as a cleaner burning fuel in power plants, cement kilns, and in the iron and steel industries. Anode grade Pet-coke (Raw Pet Coke (RPC), Green Pet coke (GPC) or non-calcined Pet-coke) is used as a feedstock for calcination in order to produce Calcined Petroleum coke (CPC). CPC is used in the aluminium, graphite electrode (e.g. for use in manufacture of lithium batteries), steel and titanium dioxide industries. Conventionally, Pet-coke properties can vary considerably depending on the chemical composition of the oil feedstock used to produce it. Hence, Pet-coke can be hard or relatively soft; physically, Pet-coke can resemble highly porous rocks, or it can resemble small marbles, ranging in size from a grain of sand to a large pebble. Embodiments of the present invention, advantageously reduce the variability of Pet-coke properties by replacing a proportion of the oil feedstock with a highly refined purified coal product.

As used herein, the term "ash" refers to the inorganic—e.g. non-hydrocarbon—mineral component found within most types of fossil fuel, especially that found in coal. Ash is comprised within the solid residue that remains following combustion of coal, sometimes referred to as fly ash. As the source and type of coal is highly variable, so is the composition and chemistry of the ash. However, typical ash content includes several oxides, such as silicon dioxide, calcium oxide, iron (Ill) oxide and aluminium oxide. Depending on its source, coal may further include in trace amounts one or more substances that may be comprised within the subsequent ash, such as arsenic, beryllium, boron, cadmium, chromium, cobalt, lead, manganese, mercury, molybdenum, selenium, strontium, thallium, and vanadium.

As used herein the term "low ash coal" refers to native coal that has a proportion of ash-forming components that is lower when compared to other industry standard coals. Typically a low ash native or feedstock coal will comprise no more than around 12% m ash. The term "deashed coal", or the related term "demineralised coal", is used herein to refer to coal that has a reduced proportion of inorganic minerals compared to its natural native state. Ash content may be determined by proximate analysis of a coal composition as described in ASTM D3174-12 Standard Test Method for Ash in the Analysis Sample of Coal and Coke from Coal. Very low ash coals, which are rare and correspondingly expensive, typically have an ash content of less than 8% m of ash.

As used herein, the term "coal fines" refers to coal in particulate form with a maximum particle size typically less than 1.0 mm. The term "coal ultrafines" or "ultrafine coal" or "ultrafines" refers to coal with a maximum particle size typically less than 0.5 mm (500 microns (μm), approximately 0.02 inches). The term "coal microfines" or "microfine coal" or "microfines" refers to coal with a maximum particle size typically less than 20 μm.

As used herein, the term "water content" refers to the total amount of water within a sample, and is expressed as a concentration or as a mass percentage (% m). When the term refers to the water content in a coal sample it includes the inherent or residual water content of the coal, and any water or moisture that has been absorbed from the environment. As used herein the term "dewatered coal" refers to coal that has an absolute proportion of water that is lower than that of its natural state. The term "dewatered coal" may also be used to refer to coal that has a low naturally-occurring proportion of water. Water content may be determined by analysis of a native or purified coal composition as described in ASTM D3302/D3302M-17 Standard Test Method for Total Moisture in Coal. Coal considered as dewatered typically comprises no more than 10% m of water, typically no more than 5% m of water, and optionally less than 2% m of water.

The term "hydrocarbonaceous material" as used herein refers to a material containing hydrocarbons; hydrocarbons being an organic compound consisting substantially of the elements hydrogen and carbon. Hydrocarbonaceous material may comprise aliphatic as well as aromatic hydrocarbons. Hydrocarbonaceous materials of mineral origin may further comprise one or more heteroatoms, such as nitrogen, oxygen, or sulfur.

The term "fractionation" is used herein to refer to the separation of a mixture into different portions. The term "fractionation" will encompass a separation process in which a certain quantity of a mixture (gas, solid, liquid, or suspension) is divided during a phase transition, into a number of smaller quantities (fractions) in which the composition varies according to a gradient. Fractionation includes "fractional distillation" which is the separation of a mixture into its component parts, or fractions, based on differences in their boiling point. Any distilled output product from a fractionation technique may be termed "fractionation products". The viscous residue from atmospheric fractional distillation may be used as a feedstock for further upgrading via vacuum distillation, as a fuel component, or to contribute to a bituminous fraction. Fractionation, or fractionated, products have fewer components, or are more pure than the unrefined products from which they derive. Typically, atmospheric distillation of crude oil is completed at temperatures ranging from around 300 to around 350° C. at or near atmospheric pressure. The atmospheric residue may then be passed to a vacuum distillation unit that operates at around 350° C. with around 40 mmHg (approximately 53 millibar) of vacuum.

Coal mines, especially multi-seam surface mines and associated coal processing and preparation plants, are limited in output and market pricing by the availability of high grade quality seams needed to meet high specifications for coking and pulverised coal injection (PCI) coals. These limitations are leading to lower and less efficient production of this important chemical feedstock from a rapidly diminishing worldwide resource base. Tighter product specifications for internationally traded thermal coals are also leading to lower, and less efficient, production in the coal industry. As a result of more demanding environmental standards, coal processing plants are increasingly also limited in their ability to store waste coal product in tailings ponds, impoundments or tips.

Thermal coals sold and traded internationally for power generation, are typically high in ash content (at least 15-20% m dry basis), high sulphur content (1-2% m dry basis), moderately-high water content (10-15% m or higher) and with a relatively coarse particle size distribution (<50 mm). Coal power plant boilers utilise pulverised PCI fuel (i.e. dried coal particles, typically in the size range 20-120 microns) and consume significant amounts of energy in crushing, drying and pulverising thermal coals. The ash generated during combustion has to be removed either as slag ash or fly ash: in both cases ash reduces operational efficiency and incurs environmental as well as commercial costs for disposal. Power stations utilise flue gas desulphurisation techniques to minimise the emissions of sulphur oxides to the atmosphere; the cost of operating such desulphurisation techniques is proportional to the coal feedstock sulphur content.

Coal seams with high ash content are abundant worldwide, from numerous geological reserves, sometimes as thick seams persisting over a wide geographical area, but many are not exploitable economically due to the problems described above.

When insufficient residue is available at the refinery to operate a delayed coker at full capacity, then additional components can be imported to increase throughput and operating efficiency. The invention relates to the addition of microfine coal to conventional and non-conventional coker feed-stock, which can be introduced by blending with a hydrocarbonaceous liquid component prior to thermal pretreatment in a delayed coker or flexi-coker. Such blends enable the production from a coal-based feedstock of distillate material and petroleum coke formed at the cracking temperatures in the preheater and coke drums. By doing this, the throughput of a delayed coker or flexi-coker can be increased by providing alternative feedstock external from the refinery, and the flexibility of refinery operations is increased by freeing up residue for other uses.

Residue oil in the context of this application is understood to refer to residue that is obtained after at least one stage of oil refinement such as residue from refinery atmospheric and vacuum distillation of crude oil feedstock; residue from other refinery processes, such as Slurry oil from catalytic crackers and/or bottoms from naphtha crackers (carbon black feedstock); slop oils; decanted oils; oils and tars produced by pyrolysis of coal (e.g. coal-tar pitch), wood and biomass; black liquor, the waste product from the Kraft process of wood pulp manufacture; lower viscosity oils from the refinery (e.g. cycle oils, gas oils etc.). Residue oil may also be lower viscosity oils from biofuel manufacture (e.g. fatty acid methyl esters) used to pre-mix microfine coal to a paste, before blending with any one of the above hydrocarbonaceous liquid materials.

It was not previously known that co-distillation of heavy hydrocarbonaceous liquids such as residue oil together with coal-fines, particularly comprising micro- and nanoscale coal particulates, would provide significant amounts of high quality grade coke at temperatures of around or over 450° C. These amounts are in addition to those attributable to the distillation of the hydrocarbonaceous liquid component alone and are therefore attributable to the presence of solid material.

Without wishing to be bound by theory, it is understood that when distilling coal fines as a blend with residue oil, any coal tars and liquids generated during pyrolysis are condensed together with the traditional distillate fractions from residue oil. In addition, the presence in residue oil of various hydrocarbon species that could act as hydrogen donors to facilitate breakdown of the coal polymeric structure could enhance the generation of condensable hydrocarbon fractions. Utilising already existing process equipment avoids large-scale investment in major new manufacturing facilities and plant. This represents a significant advantage in economic terms of the present invention.

According to embodiments of the present invention, there is provided a process for the pyrolysis and distillation of a residue oil blended with coal-fines of any specification to produce distillate products and coke. A particular embodiment of the invention relates to the pyrolysis and distillation of a residue oil blended with coal-fines wherein the coal-fines have a specification, in particular, a water content and an ash content that provides, following distillation, distillate products that meet the appropriate product and environmental emission criteria. Distillate products that meet or exceed the required specification for the product type are of higher value and therefore render the overall process, as described herein, highly commercially viable.

Recent developments processing of coal fines have made available a microfine coal product, PCP, that has a low water content (<15% m, typically <7% m, suitably <3% m) and a low ash content (<10% m, typically <5% m, suitably <2%). The process of demineralisation of PCP also has a beneficial effect on sulphur content via removal of iron pyrites. Demineralising and dewatering of coal fines is typically achieved via a combination of froth flotation separation, specifically designed for ultrafines and microfine particles, plus mechanical and thermal dewatering techniques. A typical process for the production of de-watered coal ultrafines is provided in US-2015/0184099, which describes a vibration assisted vacuum dewatering process. It will be appreciated, however, that several other suitable dewatering processes also exist within the art, for example, providing coal as cake comprising coal fine particles in a hydrocarbon carrier with water having been removed through the use of one or more hydrophilic solvents.

Any particle size of coal fines that is suitable for distillation with residue oil is considered to be encompassed by the invention. Suitably, the particle size of the coal fines is in the ultrafine range. Most suitably the particle size of the coal fines is in the microfine range. Specifically, the maximum average particle size may be at most 500 μm. More suitably, the maximum average particle size may be at most 300 μm, 250 μm, 200 μm, 150 μm, or 100 μm. Most suitably, the maximum average particle size may be at most 75 μm, 50 μm, 40 μm, 30 μm, 20 μm, 10 μm, or 5 μm. The minimum average particle size may be 0.01 μm, 0.1 μm, 0.5 μm, 1 μm, 2 μm, or 5 μm. Hence, in particular embodiments the invention includes utilisation of nanoscale coal fines with average particle sizes in the sub-micron range.

An alternative measure of particle size is to quote a maximum particle size and a percentage value or "d" value for the proportion by volume of particles within the sample that fall below that particle size. For the present invention any particle size of coal fines that is suitable for distillation with crude oil is considered to be encompassed by the invention. Suitably, the particle size of the coal fines is in the ultrafine range. Most suitably the particle size of the coal fines is in the microfine range. Specifically, the maximum particle size may be at most 500 μm. More suitably, the maximum particle size may be at most 300 μm, 250 μm, 200 μm, 150 μm, or 100 μm. Most suitably, the maximum particle size may be at most 75 μm, 50 μm, 40 μm, 30 μm, 20 μm, 10 μm, or 5 μm. The minimum particle size may be 0.01 μm, 0.1 μm, 0.5 μm, 1 μm, 2 μm, or 5 μm. Any "d" value may be associated with any one of these particle sizes. Suitably, the "d" value associated with any of the above maximum particle sizes may be d99, d98, d95, d90, d80, d70, d60, or d50. To maximize the reaction of coal in a delayed coker process, it is desirable for the coal particle size to be both relatively homogeneous and small, in order to enable the small particles to be well-dispersed in the residue oil phase. For instance, in a specific embodiment of the invention the microfine coal has a d90 of <100 μm, <90 μm, <70 μm, <50 μm optionally <20 μm. Suitably, the microfine coal has a d99 of <70 μm, <60 μm, <50 μm, <40 μm optionally <20 μm.

According to a specific embodiment of the invention a process is provided that blends (i.e. suspends) the solid particulate matter of de-watered, demineralised microfine coal in residue oil, prior to pyrolysis and fractionation. Upon fractionation at reduced pressure, a significant amount of coke is produced which cannot be accounted for by the pyrolysis and distillation of the residue oil component alone. This coke product is, therefore, derived from presence of microfine and/or ultrafine coal.

The residue oil may be selected from the group consisting of: residue from refinery atmospheric and vacuum distillation of crude oil feedstock; residue from other refinery processes, such as Slurry oil from catalytic crackers and/or bottoms from naphtha crackers (carbon black feedstock); oils and tars produced by pyrolysis of coal (e.g. coal-tar pitch), wood and biomass; black liquor, the waste product from the Kraft process of wood pulp manufacture; lower viscosity oils from the refinery (e.g. cycle oils, gas oils etc.). The residue oil may also be lower viscosity oils, including those from biofuel manufacture (e.g. fatty acid methyl esters). Any of the above hydrocarbonaceous materials can be used to pre-mix microfine coal to a paste, before blending with any one of the above hydrocarbonaceous liquid materials.

Hence, according to a specific embodiment of the invention, a feedstock of residue oil as described above such as vacuum residue and other process residues are conveyed to a thermal fractionator (e.g. distillation column) where valuable lighter fractions are distilled off. Such lighter fractions may comprise one or more of the group consisting of: heavy gas oil; light gas oil; kerosene; coker naphtha, diesel; gasoline; and gas.

From there, heavy bottoms residue from the thermal fractionator is heated to its cracking temperature of in excess of 450° C. (suitably around 480° C.) in the presence of steam in a furnace and then routed to one or more coke drums. Without wishing to be bound by theory, it is believed that thermal cracking already begins in the feed pipe between the furnace and the one or more coke drums and finishes in the drum. The addition of steams assists in preventing deposition of coke in the feed pipe. Further thermal cracking occurs inside the coke drum and additional distillates and gas are driven off leaving deposited solid coke within the coke drums which can be reclaimed and has value as a 'clean carbon' thermal fuel in metallurgy (e.g. aluminium, steel and other metal production). The distillates and gas are returned to the fractionator or to another refinery process. Typically, the coker apparatus will comprise at least a first and a second coke drums, such that whilst the first drum is filling with coke the second drum is steamed to further reduce the hydrocarbon content of the coke and then quenched with water for cooling. After the first drum has filled, the process is switched to the second drum so that the hot mixture from the furnace reaches the second drum to allow for a continuous production process. A high pressure decoking derrick may be positioned above the one or more coke drums and may be used to deliver high pressure water to the coker drum in order to facilitate removal of the coke which is usually collected from the bottom of the drum. This may also be referred to as hydraulic decoking (Petroleum Processing, Vo. 5, No. 2, 1950) (see FIG. 1).

In embodiments of the invention demineralised microfine coal (e.g. PCP) is typically combined with the residue oil feed prior to heat-treatment by the furnace. The microfine coal may be added into the delayed coking system as powder but is suitably mixed with residue oil feedstock. The resultant PCP in oil slurry is pumpable. Similar steps may occur when using fluidised bed or flexi coker set ups.

The amount of microfine coal that may be blended with the residue oil is at least 1% m (one mass percent), suitably at least 5% m, typically around up to 20% m, optionally around up to 30% and at most 70% m, suitably at most 60% m, optionally at most 50% m. Hence, the microfine coal component may comprise a majority, by mass, of the resultant residue oil or residue bottoms blend. This allows for considerable economies of production, by replacing a significant proportion of liquid component with cheaper solid material. The combined blend may also be introduced into existing apparatus and processes without extensive re-design of conventional equipment.

In a further embodiment of the present invention, a process for operating a fluid coker or flexi-coker is also provided. Fluid bed cokers typically comprise a reactor, or coking vessel, and a heater vessel. Residual feed stock is sprayed as a liquid directly into the coking reactor where the liquid feed is distributed as a thin oil film on hot, fluidised coke particles. As the oil film cracks, it vaporises and is quickly removed from the coking zone thereby avoiding secondary reactions. During the process a portion of removed coke is burned with air to provide heating for the reactor. Hence, the fluid coking process can operate continuously with only a single reactor and single heater. According to the present invention the fluid coker process may be adapted so that it comprises one or more of the following steps:

- preheated feed comprising a combination of residue oil and PCP, as described herein, is sprayed into a bed of hot fluidized petroleum coke particles comprised within a first vessel which provide the heat necessary for thermal cracking.
- Cracked products are separated from the coke particles and removed from a first reaction vessel into a fractionator.
- In a second reaction vessel, a portion of the coke particles are combusted to generate heat, and a portion of the coke particles are withdrawn as coke product.
- In the case of Flexi-coking, these hot coke particles are then subjected to gasification in a third reaction vessel Pre-blending of solid material with such hydrocarbonaceous liquids to produce a homogeneous, stable mixture as feedstock is enhanced by the use of a microfine coal, with particle size below around 20 microns and with a moisture content below around 5% m.

Using a microfine coal (d90<50 microns) with very low ash content (<2% m) and low sulphur (<1% m) enables the resultant coke to meet specifications for higher value product, such as anode coke. Anode coke is used in the steel and aluminium industries to melt the raw materials. It is of considerable benefit that such a microfine coal can be derived from lignite, sub-bituminous coal and bituminous coal from any geological age or origin. In addition, it certain embodiments, it may be derived from low grade coal that, prior to demineralisation, would have been considered of little if any commercial value let alone that is could be upgraded as an ingredient of Anode-grade Pet-coke.

The invention facilitates the use and upgrading of microfine coal into higher value volatile products, e.g. distillate fractions, as well as production of Pet-coke. Further, conventional equipment that requires little or no additional modification can be used. Such distillate fractions may be distinguished from typical volatile products derived from delayed, fluid or flexi cokers using an exclusive residue oil feedstock, in that they can contain elevated oxygen content depending on the chemical composition of the original coal source. As is demonstrated in the examples, below, PCP from coals having higher volatile content can contribute substantially towards liquid distillate fractions. The present inventors have surprisingly found that the PCP can contribute to a shift away from lower value gaseous products, usually produced during the coking process of residual oil, towards higher value liquid fractions. Hence, the PCP may be utilised as an additive (possibly at lower % m concentrations) to conventional coker processes in order facilitate and/or enhance the production of liquid fractions, and correspondingly reduce the production of gaseous fractions (e.g. carbon dioxide, fuels gas, LPG).

The particle size and size distribution choice of the microfine coal enables a stable dispersion of the coal within the hydrocarbonaceous liquid allowing for delivery of the mixture to a coking facility via a simple supply chain.

A synergistic interaction between the microfine coal and the residual oil feedstock/fractionator residue leads to an unexpectedly beneficial change in the composition of recovered high value fractions. Further, the high surface area generated by the microfine coal particles aids uniform reactivity with the residue fuel resulting in a homogeneous product with improved morphology.

Microfine coal increases the economic performance of a refinery coker by increasing the utilisation of excess coker plant capacity. Further, the pet-coke produced is very low in sulphur, nickel and vanadium, so increases the commercial value of the pet-coke as a component for high grade manufacturing of steel, aluminium and other metal alloys.

In embodiments of the invention, the coke prepared according to the described methods may be subjected to one or more additional calcination steps in order to produce a calcined coke product. Calcined coke is used in a variety of industries and applications; in particular it is a valuable material for the production of carbon anodes, as well as in the manufacture of titanium dioxide. Coke produced by the methods described, may be calcined in rotary kilns, where the coke is heated to temperatures between 1200 and 1350° C. (2192 to 2460° F.). The elevated heat treatment removes any excess moisture, extracts all remaining hydrocarbons and modifies the crystalline structure of the coke, resulting in a dense electrically conductive product.

The invention is further illustrated by the following non-limiting examples.

EXAMPLES

Demineralising and dewatering of coal fines may be achieved via a combination of froth flotation separation, specifically designed for ultrafines and microfine particles, plus mechanical and thermal dewatering techniques.

In all of the examples, purified coal product that comprises demineralised and dewatered microfine coal is used as a coal replacement product. The purified coal product (PCP) may be prepared by a multi-step process as set out below:

- A representative sample of coal waste slurry, e.g. Queensland medium-volatile bituminous coal A, derived from an impoundment, tailings pond or production tailings underflow is taken.
- The sampled material is reduced to a particle size of d80=30-50 microns (or finer in some coals) to achieve efficient separation to a target ash content of 5-8%. To achieve this, the feed is diluted with water to achieve a solids content of in the range 20-40%, then ground in a ball or bead mill depending on the top size of the feed. The product is screened at a size range of approximately 100 microns. In some circumstances a dispersant additive (e.g. lignin-based dispersants, such as Borresperse, Ultrazine and Vanisperse manufactured by Borregaard, 1701 Sarpsborg, Norway) is included to optimise energy use. Suitable equipment is manufactured by Metso Corporation, Fabianinkatu 9 A, PO Box 1220, FI-00130 Helsinki, FIN-00101, Finland, Glencore Technology Pty. Ltd., Level 10, 160 Ann St, Brisbane QLD 4000, Australia, and FLSmidth, Vigerslev Allé 77, 2500 Valby, Denmark.

Typically, one stage of flotation (one course step and several finer steps) is carried out to bring the ash content down to the target level. For some coals where the mineral matter is disseminated mainly within sub-10-micron size domains, more than one stage of flotation following further milling may be required.

The coal slurry is diluted further with water typically to a range of 5-20% m solids then collected in a tank and froth flotation agents, known as frother (e.g. methyl iso-butyl carbinol and pine oil) and collector (e.g. diesel fuel or other hydrocarbon oil, and Nasmin AP7 from Nasaco International Co., Petite Rue 3, 1304 Cossonay, Switzerland), are added using controlled dose rates. Micro particle separators (e.g. Flotation test machines manufactured by FLSmidth, Vigerslev Allé 77, 2500 Valby, Denmark, by Metso Corporation, Fabianinkatu 9 A, PO Box 1220, FI-00130 Helsinki, Finland, and GTEK Mineral Technologies Co. Ltd.) filled with process water and filtered air from an enclosed air compressor are used to sort hydrophobic carbon materials from hydrophilic mineral materials. Froth containing hydro-carbonaceous particles overflows the tank and this froth is collected in an open, top gutter. The mineral pulp is retained in the separation tank until discharged, whereas the demineralised coal slurry is de-aerated, before being pumped to the pelletisation step.

The concentrate from froth flotation is then dewatered with a filter-press or tube-press to a target range of 20-50% m depending on the actual particle size, under pressure or vacuum, sometimes with air-blowing, to remove water by mechanical means, in order to generate feed for the extruder. Suitable filter-press equipment is manufactured by Metso, FI-00130 Helsinki, Finland, FLSmidth, Valby, Denmark, and by Outotec. Rauhalanpuisto 9, 02230 Espoo, Finland.

In some instances, flocculant (or thickener, e.g. anionic polyacrylamide additive manufactured by Nalco Champion, 1 Ecolab Place, St. Paul, MN 55102-2233, USA) is added to optimise settling properties and underflow density. To optimise the procedure settling tests are carried out to measure settling rates and generate a settling curve, tracking underflow density with time.

Filtration may also be necessary depending on the filtration rate and resultant cake moisture. To optimise the procedure feed % solids (thickened/unthickened), feed viscosity, pH and filtration pressure will be measured, Filter cloths are chosen after assessment of cake discharge and blinding performance. Suitable filter cloths are manufactured by Clear Edge Filtration, 11607 E 43rd Street North, Tulsa, Oklahoma 74116 USA.

In some circumstances a Decanter Centrifuge can be incorporated into the process design to concentrate the solids content prior to the filter press. Suitable equipment is manufactured by Alfa Laval Corporate AB, Rudeboksvagen 1, SE-226 55 Lund, Sweden.

An extruder or pelletiser or briquetter may be used to compact the wet cake of microfine coal into pellets, if required, to provide mechanical integrity and enable shipping. However, PCP is typically used in micronized form for the production of Pet-coke as described in the following Examples.

Example 1.—PCP Blending Characteristics Compatibility with Petroleum Coke Specifications Table 1 shows those specifications for three different grades of petroleum coke which would be affected by including PCP as a blend component. The values of each property for two types of PCP (designated 'Arq Fuel A' and 'Arq Fuel B') and the contribution to each property by 10% of either PCP are also given.

Table 1 shows the maximum negative impact of PCP on coke properties, since the calculations assume that all of the hetero atoms (O, N, SO) as well as all of the inorganic matter will report to the coke fraction. In reality, each of these elements partitions between the solid and volatile (gas and liquid) products, reducing the net amount in the product coke. Finally, additional hetero atom removal is expected during calcination of the coke, whether derived from residue oil or from PCP or from a blend of these feeds.

Nitrogen content is required to be very low for calcined needle coke. Although nitrogen will disproportionate during pyrolysis of PCP mainly into the liquid and gaseous products (such as ammonia), a blend containing just 1% Arq Fuel A could probably still be unacceptable for particular needle coke applications. However, nitrogen is one of the hetero atoms that will partition between the coke product stream and the liquid product stream. Some of the nitrogen even reports to the gaseous product stream as ammonia. All of these partitionings serve to reduce the nitrogen value in the coke. With a nitrogen content of 17,000 ppm,w Arq Fuel A concentrations of up to 45% could be readily accommodated for fuel coke uses. Nitrogen content is not a specification parameter for anode coke.

Ash content: With an ash content of just 1.0% m, concentrations of 30-40% of Arq Fuel A could be accommodated for both fuel coke and calcined anode coke, similarly as much as 60-80% of Arq Fuel B could be accommodated. This represents the potential for replacement of a significant proportion of the residue oil feedstock with PCP in the delayed coker process.

Sulphur content: With a sulphur content of 0.8% m, the concentration of sulphur in Arq Fuel A is below that specified for fuel coke and anode coke, so sulphur content would not limit the blending concentration of Arq Fuel in either of these coke grades. The sulphur content for needle coke is lower, nevertheless a range of 25%-60% m of Arq Fuel A (or 50%-100% of Arq Fuel B) could be accommodated depending on the precise sulphur spec limit. Again, this represents the potential for replacement of a significant proportion of the residue oil feedstock with PCP in the delayed coker process.

Nickel and Vanadium contents: The concentrations of nickel and vanadium in Arq Fuel A are below the levels specified, so neither element would limit the concentration of Arq fuel that could be blended to meet any of the three coke specifications.

Arq Fuel blending characteristics meet petroleum coke specifications at least for fuel coke and anode coke. Ignoring any operational constraints, concentrations of up to 70% m and up to 80% m of Arq fuel B could be accommodated within fuel coke and anode coke respectively without exceeding specification limits.

TABLE 1

Specification for three grades of petroleum coke and two types of PCP (Arq Fuel)

| Property | Units | Fuel coke | Calcined Anode coke | Calcined Needle coke | Arq Fuel A | 10% Arq Fuel A | Arq Fuel B | 10% Arq Fuel B |
|---|---|---|---|---|---|---|---|---|
| Bulk density | kg/m3 | 880 | 720-880 | 670-720 | n a. | | n.a. | |
| Ash content | %, m | 0.35 | 0.4 | 0.1 | 1.0 | 0.1 | 0.5 | 0.05 |
| Sulphur | | 3.5-7.5 | 1.0-3.5 | 0.2-0.5 | 0.8 | 0.08 | 0.5 | 0.05 |
| Nitrogen | ppm, w | 6000 | n.a. | 50 | 17000 | 1700 | not available | |
| Nickel | | 489 | 200 | 5-7 | 5 | 0.05 | | |
| Vanadium | | 141 | 350 | n.a. | 56 | 5.6 | | |

Example 2. —Blending of Waste-Derived PCP with Residual Oil

To achieve good dispersion, the PCP must initially be finely ground. An average (D50) particle size of about 5 microns and a maximum particle size of about 10 microns (d99) gives excellent performance.

To disperse such a powder into a vacuum residue or residual fuel oil requires high shear mixing. The type of mixing found in a rotor/stator device such as those manufactured by Silverson or KADY International are particularly useful in achieving a uniform, well-dispersed slurry, although other types of mechanical and static mixers may be employed. Depending on the physical and chemical properties of both the coal and oil, a good dispersion may require only a single pass through such a device, or may require repeated re-circulation.

The high shear mixing is best carried out at temperatures where the viscosity of the oil phase is less than 500 cSt, and suitably less than 100 cSt. Such a viscosity ensures sufficient fluidity for the coal particles to be enrobed in oil, and for the oil to penetrate at least some of the pores within the coal particle. Thus both "external" and "internal" surface area of the coal particles are brought into contact with the oil phase.

Once prepared, the slurry should be maintained in well-dispersed state prior to introduction into the coker. Depending on the oil viscosity at storage temperature, this may require constant stirring, intermittent mixing or no mixing.

Example 3. —PCP Blending Characteristics' Compatibility with Delayed Coker Feed Specifications

TABLE 2

Key coker feed specification parameters compared with values for 10% m PCP (Arq Fuel)/Residue Fuel blends

| Test | Method | Units | Commercial Pet-coke specification | Arq Fuel | RF-A | RF-A + 10% Arq Fuel | RF-B | RF-B + 10% Arq Fuel |
|---|---|---|---|---|---|---|---|---|
| Density at 15° C. | ASTM D4052 | kg/m3 | | not | 974 | 1009 | 1096 | 1114 |
| API gravity @ 60° F. | | | | applicable | 13.8 | 8.7 | −2.4 | −4.5 |
| Viscosity @ 50° C. | ASTM D445 | cSt | <1160 | | 167 | 384 | 341 | 763 |
| Vicosity @ 135° C. | ASTM D7042 | | | | | not available | | |
| Gross calorific value | ASTM D240 | MJ/kg | | 35.5 | 42.5 | 41.8 | 40.3 | 40.0 |
| Flashpoint | ASTM D93 | ° C. | >90 | not | 117 | 135 | 123 | 130 |
| Pour Point | ASTM D97 | ° C. | <43 | applicable | 15 | 24 | 6 | 9 |
| TAN | ASTM D664 | mgKOH/g sample | <1.5 | | 0.188 | | not available | |
| Sulphur | IP336 | % m | <6.2 | 0.5 | 1.11 | 1.05 | 1.90 | 1.72 |
| Ash | ASTM D482 | | <0.24 | 1.0 | <0.01 | 0.10 | 0.05 | 0.12 |
| Water | ASTM D95 | | <0.5% | 2.0 | <0.05 | 0.20 | 0.05 | 0.10 |
| Asphaltenes | % m | ASTM D3279 | | not | | not available | | |
| Conradson Carbon | | ASTM D4530 | | applicable | | | | |
| CCR/Asph ratio | | | >1.8 | | | | | |
| Total Nitrogen | ASTM 4629, 5762 | ppm, w | <10,000 | 17000 | 3100 | 4490 | not available | |
| Vanadium | ASTM D5184 | | <400 | 20 | 18 | 18 | 6 | 8 |
| H2S in Vapour | ASTM D5705 | ppm | <150 | nil | nil | nil | not available | |

| Test | RF-C | RF-C + 10% Arq Fuel | RF-D | RF-D + 10% Arq Fuel | RF-E | RF-E + 10% Arq Fuel |
|---|---|---|---|---|---|---|
| Density at 15° C. | 964.5 | 993.5 | 1019 | n.a. | 989.9 | 1017 |
| API gravity @ 60° F. | 15.2 | 10.9 | not available | | 11.4 | 7.6 |
| Viscosity @ 50° C. | 254 | 387 | | | 310 | 620 |
| Vicosity @ 135° C. | not available | | 363 | | | |
| Gross calorific value | 43 | 42.4 | not available | | 42.8 | 41.7 |
| Flashpoint | 102 | 112 | 470 | not | 108 | 125 |
| Pour Point | 24 | 27 | not | available | 6 | 12 |
| TAN | 0 | 0 | available | | 0.3 | 0.2 |
| Sulphur | | | 3.54 | 3.24 | 3.2 | 2.9 |

TABLE 2-continued

Key coker feed specification parameters compared with values for 10% m PCP (Arq Fuel)/Residue Fuel blends

| | | | | | | |
|---|---|---|---|---|---|---|
| Ash | 0.04 | 0.13 | 0.08 | 0.17 | <0.01 | 0.10 |
| Water | | | not | not | 0.05 | 0.25 |
| Asphaltenes | 14.9 | 15.7 | available | available | not available | |
| Conradson Carbon | 9.3 | 16.6 | 26.1 | 13.4 | | |
| CCR/Asph ratio | 0.6 | 1.1 | not available | | | |
| Total Nitrogen | | | not available | | | |
| Vanadium | 39 | 37 | 324 | 294 | 145 | 133 |
| H2S in Vapour | <0.1 | <0.1 | not available | | | |

Surprisingly, the sulphur content (all five RF-A-E), Flash Point (RF-A, B, C and E), Vanadium content (the more typical higher vanadium RFO samples: RF-C, D and E) and TAN (RF-E) are actually improved by blending with Arq Fuel.

Viscosity at 50° C. and Pour Point are increased by addition of PCP but both parameters remain well below specification limits of 1160 cSt and 110° F. (43.3° C.) respectively in the 10% blends of RF-A, B, C and D.

Ash and water contents are increased by addition of Arq Fuel, but not significantly and both remain well below specification limits of 0.24% m and 0.5% m respectively in all 10% blends shown. This suggests that the blends could accommodate additional Arq Fuel without exceeding the defined limits. Additionally, if the mixing temperature of the oil and Arq Fuel is above about 100° C., at least a portion of the water in the mixture will be released as steam.

The Conradson Carbon Residue/Asphaltene ratio and Total Nitrogen content are also increased by addition of Arq Fuel but remain well below specification limits of 1.8 (10% RF-C blend) and 10,000 ppm,w (10% RF-A blend) respectively.

Example 4.—Production of Volatiles from Different Types of Microfine Coal Under Delayed Coking Temperature-Time Conditions An optimum time-temperature profile (rate of temperature increase of 20° C./min until 460° C., thereafter isothermally at 460° C.) was developed to best represent delayed coker conditions using a 3 mg sample of PCP using a standard thermogravimetric analyser (TGA). The quantity of volatiles lost and residue remaining were determined for 13 coals of widely different rank (sub-bituminous to medium-volatile bituminous), maceral composition and geographical/geological origin.

Yields of volatile components (combined liquid and gas) ranging from 12% m for one of the higher rank coals to almost 50% m for the lowest rank coal were obtained demonstrating that significant quantities of volatiles can be generated from PCP (e.g. Arq Fuels) under delayed coker conditions.

Example 5. Production of Volatiles from Blends of Vacuum Residues and Residual Fuel Oil with Microfine Coal Three different types of residual fuel oil (RF-C, F and G, Table 2) and one vacuum residue (RF-D)il were combined with PCP (Arq Fuel) prepared from Coal 7 to form blends of 20% Arq Fuel and 80% oil. Table 4 shows the amount of volatiles boiling above 580° C. determined by simulated distillation (SIMDIS, ASTM D2887) for each oil in column 2. The volatiles generated from these oils alone under the TGA coking conditions described above are shown in column 3. These tests were repeated a minimum of 5 times to create a data set with a standard deviation less than 1%. The data presented are the averages calculated from that data set. The volatiles generated under Delayed Coker TGA from Arq Fuel and from a 20%/80% Arq Fuel/RF blend are given in columns 5 and 7 respectively, together with the standard deviation of the latter determination in column 9.

| Coal | | Size | | | | | | | Tga tests | | |
|---|---|---|---|---|---|---|---|---|---|---|---|
| | | d80 | Ash | Sulphur | VRR | Vitrinite | Inertinite | Liptinite | Residue | | Volatiles |
| code | Origin | microns | %, m | | % | % by volume | | | % m | s.d., % m | % m |
| 1 | AL, USA | 5.9 | 4.2 | 0.8 | 1.13 | 83 | 17 | 0 | 87.3 | 1.0 | 12.7 |
| 2 | WV, USA | 4.6 | 1.3 | | 0.58 | 90 | 10 | 0 | 67.7 | 0.4 | 32.3 |
| 3 | AL, USA | 5 | 2.4 | 0.6 | 0.77 | 85 | 15 | 0 | 84.0 | 0.5 | 16.0 |
| 4 | WV, USA | 5.2 | 1.2 | | 0.64 | 81 | 17 | 1 | 74.6 | 1.7 | 25.4 |
| 5 | NSW, Australia | | 0.7 | 0.5 | 0.62 | 88 | 11 | 1 | 74.4 | 1.6 | 25.6 |
| 6 | QLD, Australia | 4.6 | 2.3 | 0.5 | 0.97 | 84 | 16 | 0 | 88.4 | 0.9 | 11.6 |
| 7 | KY, USA | | 1.0 | 0.7 | 0.72 | 77 | 23 | 0 | 76.1 | 1.0 | 23.9 |
| 8 | AZ, USA | 14.9 | 2.9 | n.d. | | | n.d. | | 50.5 | 1.2 | 49.5 |
| 9 | PA, USA | 4.3 | 0.9 | | 0.53 | 88 | 12 | 0 | 81.4 | 1.0 | 18.6 |
| 10 | Jharkhand, India | 4.3 | 4.6 | 0.6 | 0.89 | 60 | 40 | 0 | 85.0 | 0.1 | 15.0 |
| 11 | Mpumalanga, RSA | 4.3 | 1.00 | 0.4 | 0.67 | 13 | 87 | 0 | 83.0 | 0.8 | 17.0 |
| 12 | QLD, Australia | | 0.5 | n.d. | 0.69 | 90 | 10 | 0 | 77.6 | 1.6 | 22.4 |
| 13 | QLD, Australia | 4.4 | 1.5 | | 1.21 | 55 | 45 | 0 | 81.4 | 1.0 | 18.6 |

TABLE 4

Comparison of Volatile yields by Delayed Coker TGA (a) determined directly on 80% Arq Fuel 20% Residue oil blends and (b) calculated from individual components.

| | 2 | 3 | 4 | 5 | 6 | 7 | 8 | 9 | 10 | 11 |
|---|---|---|---|---|---|---|---|---|---|---|
| | | | | | | Oil/Arq Fuel Blend | | | | Arq Fuel |
| | SIMDIS | Oil | | Arq Fuel | | 80%/20% | | standard | Det less | Calc. |
| | Amount | 100% | 80% | 100% | 20% | blend | | devia- | calc, % | conver- |
| 1 | <580° C. (% m) | det. | calc. | det. | calc. | det. | calc. | tion | conversion | sion |
| | | Volatiles by Delayed Coker TGA, % m[1] | | | | | | | | |
| RF-D | 18 | 83.5 | 66.8 | 24.5 | 4.9 | 72.5 | 71.7 | 0.4 | 0.8 | 28.5 |
| RF-F | 50 | 86.7 | 69.4 | 24.5 | 4.9 | 76.3 | 74.3 | 0.9 | 2.0 | 34.7 |
| RF-C | 60 | 94.3 | 75.4 | 24.5 | 4.9 | 83.6 | 80.3 | 1.0 | 3.3 | 40.8 |
| RF-G | 93 | 94.6 | 75.7 | 24.5 | 4.9 | 79.9 | 80.6 | 0.5 | −0.7 | 21.1 |

[1]The average yield from the TGA 460° C. isotherm
det. = determined, calc. = calculated By proportionating the oil alone TGA data (column 4) and the coal alone TGA data (column 6), one can calculate an expected volatiles yield for the 20%/80% blend (column 8), based on the weighted average of the volatiles from the individual components. Surprisingly, in three out of four cases, the actual volatiles yield was higher than predicted: differences between determined values and calculated values are shown in column 10. If one attributes that incremental volatiles yield to the presence of coal, then the conversion of coal to volatiles can be calculated as shown in column 11.

Figure 2:
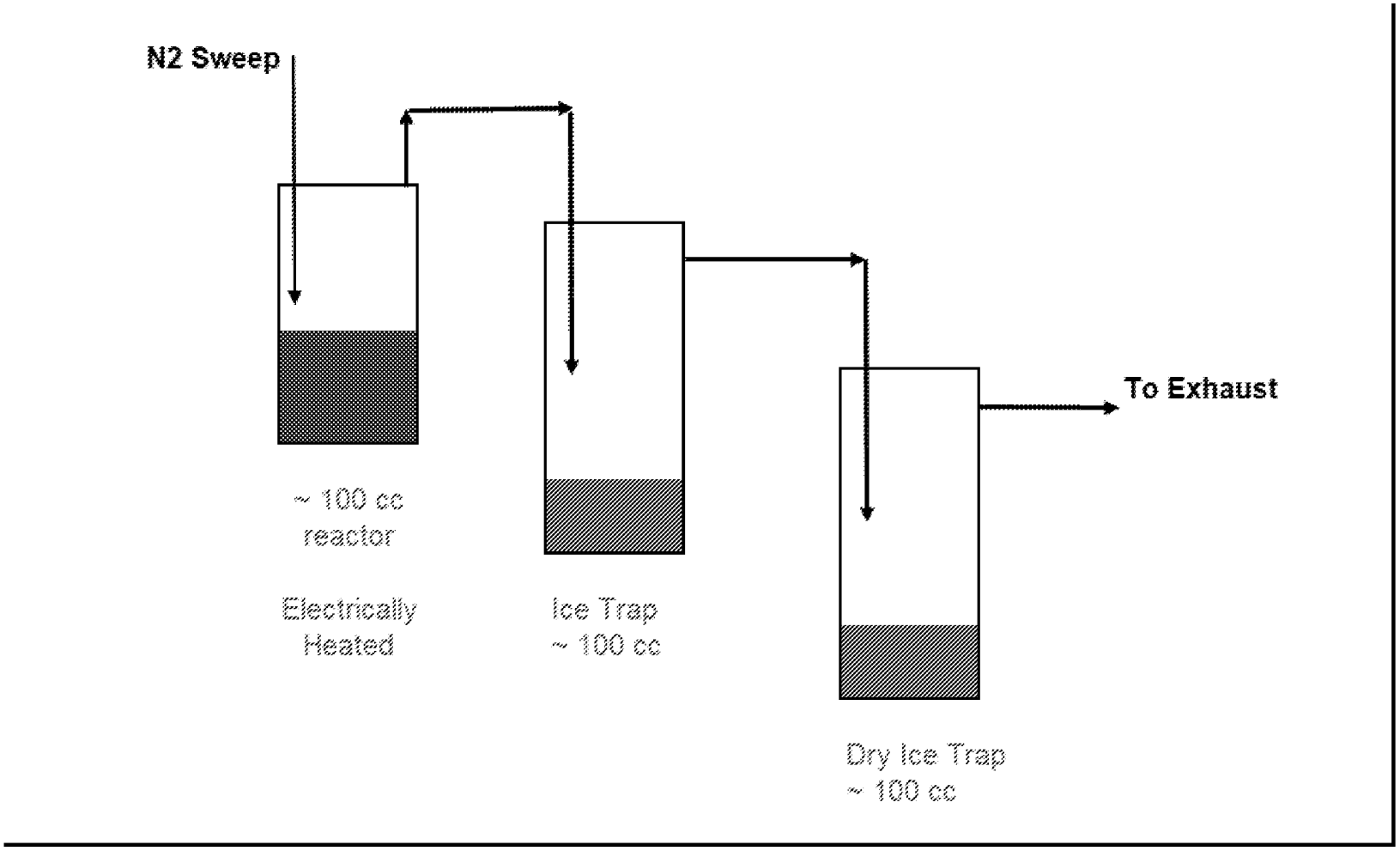
FIG. 2 shows a sketch of a Mini-Coker apparatus.

Example 6.—Production of Liquid from Residual Fuel Oils and Blends of Residual Fuel Oils with PCP (Arq Fuel) in a Bespoke Mini-Coker Rig To further model the reactions of ARQ Fuel and oil slurries in a refinery delayed coker, a lab-scale version of the coke drum was constructed as shown in FIG. 2.

The coke drum was electrically heated externally, a nitrogen sweep was provided to help remove cracked hydrocarbon products from the coke drum (simulating the steam sweep found in a commercial coker), and a series of cold traps were employed to condense and capture liquid products. Unlike the TGA experiments, the mini coker allows the determination of gas and liquid yields, rather than just volatiles, along with the yield of petroleum coke. In addition, sufficient products are generated to allow analysis for product quality.

Experiments were conducted with the oil alone and with blend of 80 wt % oil and 20 wt % coal. Each experiment was repeated at least 3 times, to insure a standard deviation less than 1%.

TABLE 5

Yields and properties of coke and liquids from residue fuel D, coal 7 (see Table 3) and a 20% blend of coal 7 in RF-D prepared in the mini-coker rig at 460° C. for two hours.

| | | RF-D | Coal 7 | 80% RF-D 20% coal 7 |
|---|---|---|---|---|
| | | Coke | | |
| Yield | % m | 21.3 | 77.8 | 32.4 |
| Ash | | 0.35 | 1.4 | 0.79 |
| C | | 88.6 | 87.1 | 88.9 |
| H | | 4.43 | 3.31 | 4.04 |
| N | | 1.36 | 1.63 | 1.56 |
| O | | 0.79 | 5.81 | 1.98 |

TABLE 5-continued

Yields and properties of coke and liquids from residue fuel D, coal 7 (see Table 3) and a 20% blend of coal 7 in RF-D prepared in the mini-coker rig at 460° C. for two hours.

| | | RF-D | Coal 7 | 80% RF-D 20% coal 7 |
|---|---|---|---|---|
| S | | 4.13 | 0.65 | 2.88 |
| H/C | | 0.6 | 0.46 | 0.54 |
| Ni | ppm, w | 295 | 19 | 168 |
| V | | 749 | 27 | 424 |
| | | Liquid | | |
| Yield | % m | 62.5 | 11.1 | 53.8 |
| C | | 86.7 | 82.86 | 85.85 |
| H | | 12.13 | 9.30 | 11.73 |
| N | | 0.19 | 0.77 | 0.25 |
| O | | 0.56 | 11.03 | 0.86 |
| S | | 1.81 | 0.51 | 1.90 |
| H/C | | 1.68 | 1.34 | 1.64 |
| | | Gas | | |
| Yield | % m | 16.3 | 10.8 | 13.9 |

Blending 20% PCP (Arq Fuel, coal 7) with fuel residue RF-D increases the yield of coke from 21.3% m to 32.4% m, and reduces the liquid yield from 62.5% m to 53.8% m (Table 6). Calculation of the relative contributions from the two blend components shows that coal 7 reacted to give 77% coke, 19% liquid and 4% gas. Blending PCP with residue oil increased the yield of liquids, the most valuable component, from 11% to 19%, almost doubling previous yield.

Coal is relatively high in oxygen compared with residue fuels and a significant portion of that oxygen is found in the liquids from coal 7 alone, which are also higher in aromaticity (low H/C) than RF-D. Surprisingly the products from the combined RF-D and coal 7 are very similar to those from RF-D alone, the increase in oxygen in the distillate fraction from the blend is minor:—

Oxygen is only increased by 0.3 wt %,
Nitrogen is only increased by 0.1 wt %,
H/C has a minor drop from 1.68 to 1.64.

The coke from the 20% blend of coal 7 and RF-D has the following differences compared with that from RF-D alone:—

Improved sulphur content. Sulfur reduced significantly from 4.13% m in RF-D to 2.88% m in blend.
Improved nickel content. Nickel reduced significantly from 295 ppm,w to 168 ppm,w. in the blend
Improved vanadium content. Vanadium reduced significantly from 749 ppm,w to 424 ppm,w in the blend The ash content of coke from the blend has increased as expected; in this case to a level (0.8% m) above fuel coke and anode coke specification limits. Coke from RF-D alone with an ash content of 0.35% m is marginally within these pet coke ash limits. It is apparent that slight modifications of blend parameters would enable production of coke with an ash content below 0.2% m. For example, by altering the blend to 10% coal 7 in RF-D would likely meet the required ash limit. Alternatively, selection of a fuel residue oil with lower inherent ash content will enable higher contents of PCP in the blend.

Figure 3:
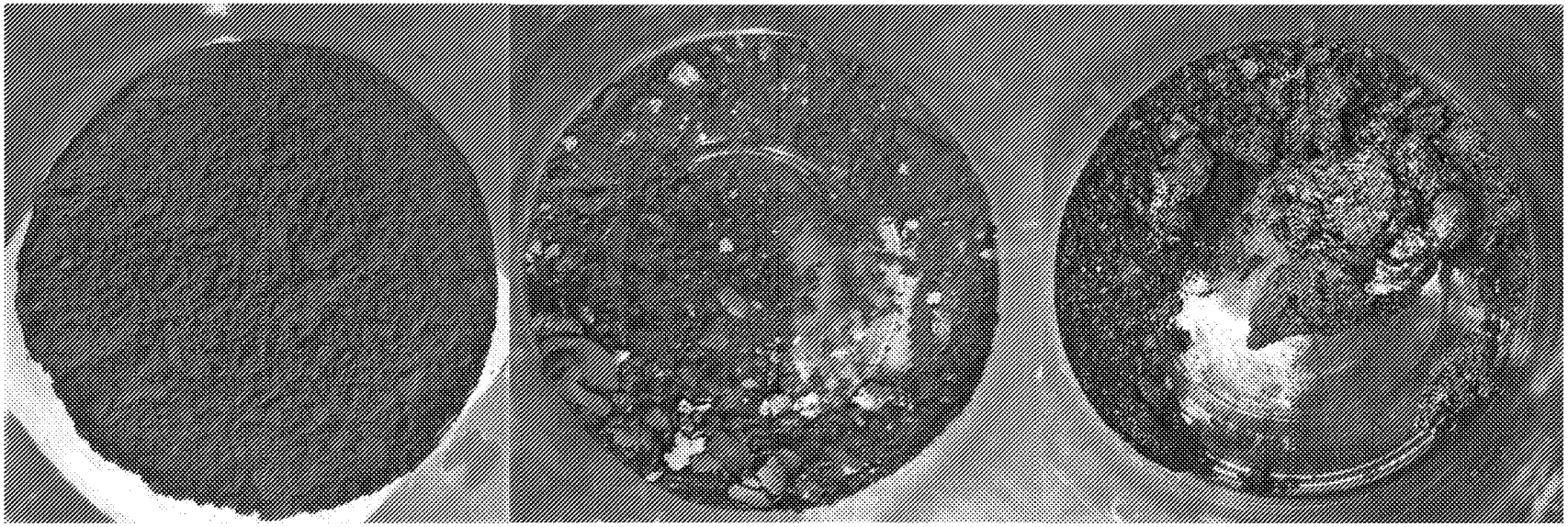
FIG. 3 shows photographs of coke generated during delayed coking using three feedstocks (a) PCP derived from a Kentucky, USA, coal (Coal 7) only; (b) vacuum residue oil (RF-D) only; and (c) A blend of 80% RF-D and 20% Coal 7 PCP.

Visual examination of the coke products from the mini-coker runs showed surprising differences in morphology (as shown in FIG. 3):

Coke made from PCP (Arq Fuel, coal 7) alone is a fluffy black powder, which did not consolidate into a mass.

Coke made from RF-D alone was hard and brittle with shiny flakes, which crumbled to the touch and appeared to have formed on the walls of the mini-coker vessel.

Coke made from the 80/20 blend of RF-D and coal 7 was a porous solid mass with high strength. All of the microfine coal particles "incorporated" into the mass, and appeared to have formed as a few "nodules" on the bottom of the coker vessel.

Example 7. —Enhanced Production of Liquid Volatiles from Blends of Fuel Residue with PCP from High-Volatile Content North American Coal (Arq Fuel)

PCP was derived from a high-volatile content North American coal from West Virginia (Coal 2 in Table 3 above) using the process described previously. Coal 2 PCP was combined with RF-D vacuum residue in an 80:20 liquid-solid blend as per Example 5 (see above). High volatiles yields were expected based on the TGA results (circa 30%). Surprisingly, the outcome from the minicoker trials significantly exceeded these expectations with yields of liquid volatiles circa 48%. It should be noted that the data was obtained from the average of three duplicate runs with this liquid-solid blend, and showed a standard deviation of only about 1%.

Without wishing to be bound by theory, it appears that there are chemical interactions occurring between the PCP and the oil, which may contribute to an increase the observed liquids yield compared to prediction based on TGA analysis for the solid PCP and residual oil independently. This may suggest that the coal derived components are interacting with gaseous products from the oil, resulting in a preferential conversion from low value gas products to significantly higher value liquid products. This observation makes it possible to extend the benefits of the present invention to a range of similar coals (including discard and waste) with high volatile content, which could represent a large and commercially available source of feedstock.

Example 8. —Production of Volatiles from Residual Fuel Oils and Blends of Residual Fuel Oils with PCP (Arq Fuel) in a Bespoke Micro-Coker Rig The previously described TGA tests were conducted at the milligram level in a mini-coker rig. The micro-coker rig increases sample size to the gram range. A quantity of coal alone (coal 4 from Table 3), oil alone, or a blend of 20 wt % coal and 80 wt % oil was loaded into a bespoke 15 ml nickel alloy vessel equipped with a press-fit lid. The lid was pierced with a 1 mm hole to allow the escape of volatiles generated during the experiment. The vessel was placed into a preheated furnace at various temperatures for various times. The percent volatiles generated was calculated from the difference between the initial and final weights of sample. By using the oil-alone and the blend data, one can calculate the conversion of the coal in the blend.

Each data point was replicated at least 5 times, and the standard deviation for each set of data was typically less than 1 percentage point.

Figure 4:
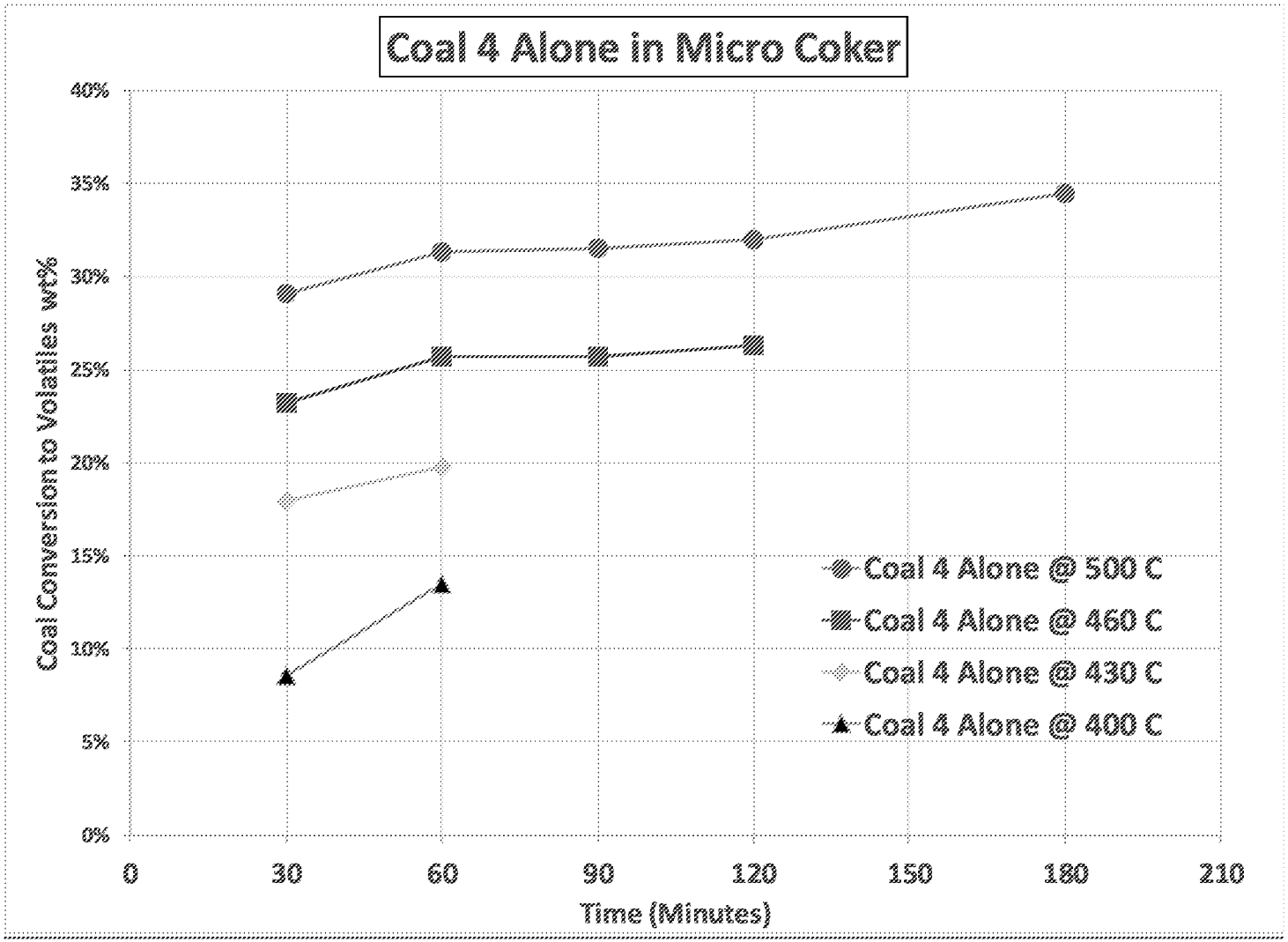
FIG. 4 shows a graph of conversion to volatiles of a coal 4 PCP at a range of temperatures in a micro-coker rig.
Figure 5:
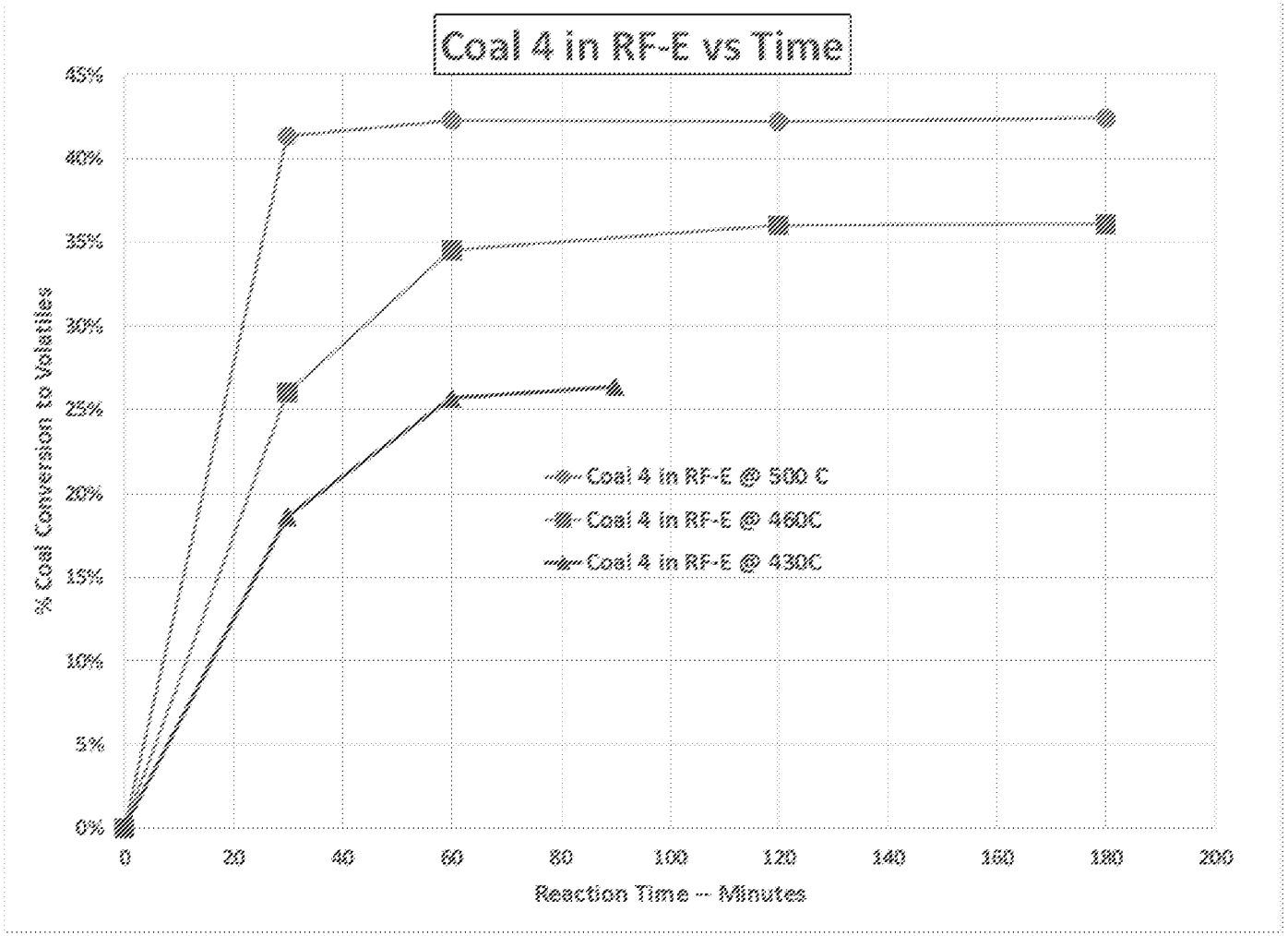
FIG. 5 shows a graph of conversion to volatiles of a coal 4 PCP in combination with a residual fuel oil at a range of temperatures in a micro-coker rig.

The conversion of Coal 4 alone at a range of temperatures is shown in FIG. 4. Conversion over a range of temperatures when mixed with a vacuum residue (RF-E in Table 2) is shown in FIG. 5. The results demonstrate the coal conversion to volatiles increased significantly as shown in FIG. 5.

Figure 6:
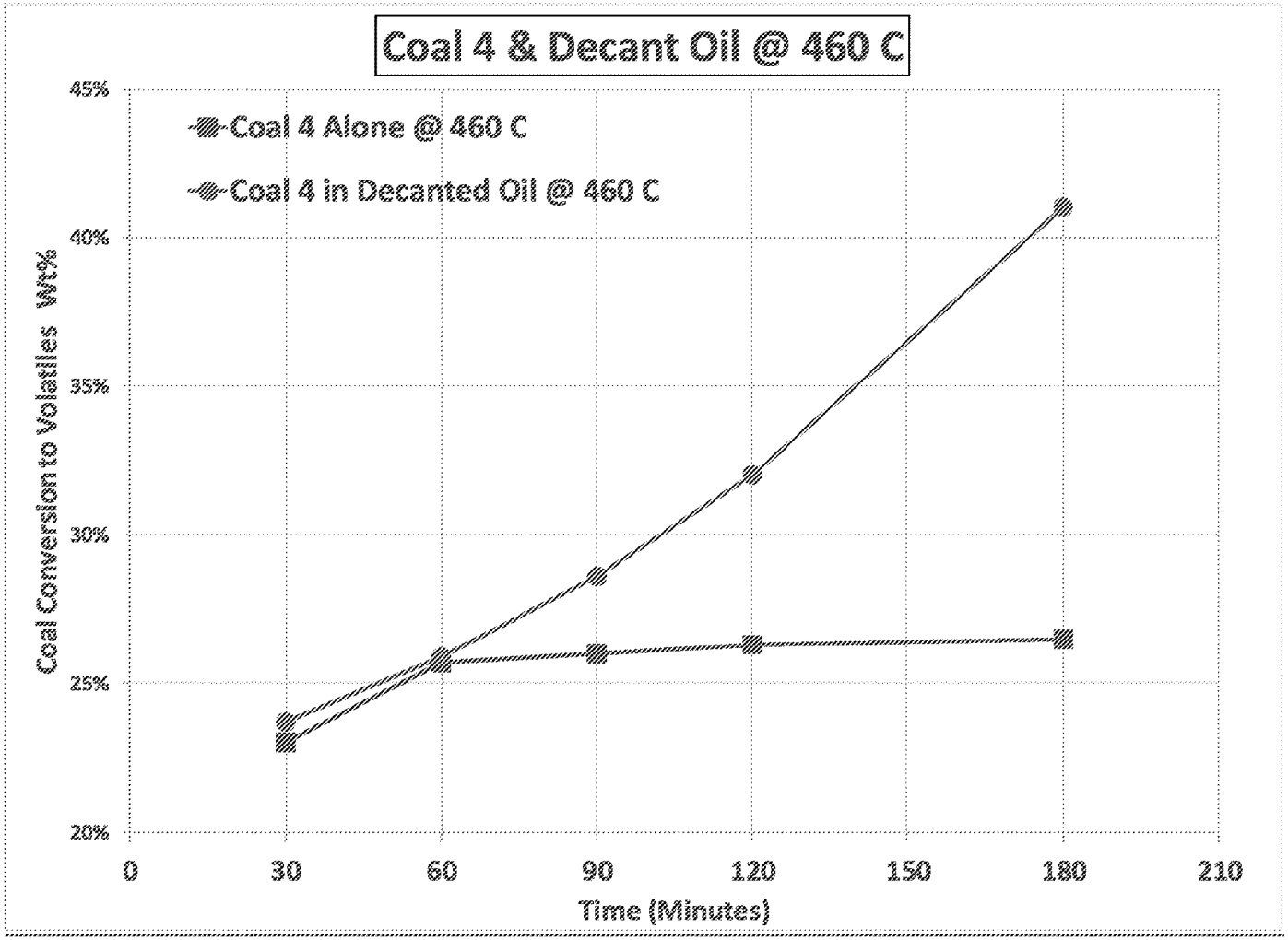
FIG. 6 shows a graph of conversion to volatiles of a coal 4 PCP in combination with a decant oil at a temperature of 460° C. in a micro-coker rig.

A similar set of experiments were conducted on blends of 20 wt % Coal 4 and 80 wt % of a decanted oil—a heavy slurry oil from a US Gulf Coast catalytic cracker. The data, summarized in FIG. 6, again shows a significant increase in coal conversion to volatiles when coked in the presence of a petroleum oil.

Example 9. —Further Improved Production of Liquid Volatiles from Blends of Fuel Residue with PCP from High-Volatile Content North American Coal (Arq Fuel)

A similar set of mini-coker experiments with Coal 4 and the same vacuum residue (RF-D) shows surprising results, including even higher conversion of the coal to liquid products. Results are summarized in Table 7:

TABLE 7

Yields and properties of coke and liquids from residue fuel D, coal 4 (see Table 3) and a 20% blend of coal 7 in RF-D prepared in the mini-coker rig at 460° C. for two hours.

| | | RF-D | 80% RF-D 20% Coal 4 |
|---|---|---|---|
| | | COKE | |
| Yield | % m | 21.3 | 28.2 |
| Ash | | 0.35 | 1.1 |
| C | | 88.6 | 86.9 |
| H | | 4.43 | 5.4 |
| N | | 1.36 | 1.5 |
| O | | 0.79 | 2.9 |
| S | | 4.13 | 3.3 |
| H/C | | 0.6 | 0.75 |
| Ni | ppm | 295 | 146 |
| V | | 749 | 521 |
| | | LIQUID | |
| Yield | % m | 62.3 | 64.72 |
| C | | 86.7 | 87 |
| H | | 12.1 | 11.4 |
| N | | 0.19 | 0.33 |
| O | | 0.56 | 1.4 |
| S | | 1.18 | 2.16 |
| H/C | | 1.68 | 1.57 |
| | | GAS | |
| Yield | % m | 16.3 | 7.1 |

From this data, one can calculate the conversion of the coal in the blend to various products. The data shows that in the coal/oil blend, the coal portion of the blend produced 58% liquid products, 49% solid products and −7% gaseous products. At first, a negative conversion to gaseous products might seem improbable. However, what this indicates is the conversion of some of the cracked products from the oil that would have normally reported to the gas phase have reacted with cracked products from the coal and formed slightly heavier species that reported to the liquid phase. This level of conversion of gas to liquid products is quite unexpected in the absence of prior hydro-treating of the fuel oil and highly significant, since liquid products are typically valued higher than gaseous products.

The invention is further exemplified in the following non-limiting numbered clauses:

1. A process for the production of coke and one or more volatile products, the process comprising the steps of:
   (i) providing a purified coal product (PCP), wherein the PCP is in particulate form, and wherein at least about 90% by volume (% v) of the particles are no greater than about 100 μm in diameter; wherein the PCP has an ash content of less than about 10% m and a water content of less than around 5% m;
   (ii) combining the PCP with a liquid residue oil in order to create a combined solid-liquid blend, wherein the solid-liquid blend comprises at least around 0.1% m and at most around 30% m PCP;
   (iii) subjecting the solid-liquid blend to a temperature in excess of 375° C. for a time period sufficient to induce cracking of at least 1% of the PCP particles to generate the one or more volatile products, and
   (iv) producing coke from the product of step (iii).
2. The process of clause 1, wherein at least about 90% by volume (% v) of the PCP particles are no greater than about 75 μm in diameter; optionally no greater than about 50 μm in diameter.
3. The process of clauses 1 or 2, wherein the PCP has an ash content of less than about 2% m, suitably less than about 1.5% m, optionally not more than 1% m.
4. The process of any one of clauses 1 to 3, wherein the PCP has a water content of less than around 2% m.
5. The process of any one of clauses 1 to 4, wherein the residue oil comprises one or more of the group consisting of: residue from refinery atmospheric distillation of crude oil feedstock; residue from vacuum distillation of crude oil feedstock; slurry oil from catalytic crackers; bottoms from naphtha crackers; oil produced by pyrolysis of plastic, wood and biomass; black liquor from the Kraft process of wood pulp manufacture; light and heavy cycle oil; light and heavy gas oil; diesel fuel; fuel oil; bunker oil; boiler fuel oil; decanted oil; marine fuel oil; marine diesel oil; biodiesel; slop oil; oils derived from tar sands; crude oil; synthetic crude oil; and oil from biofuel manufacture.
6. The process of any one of clauses 1 to 4, wherein the solid-liquid blend of (iii) is used as a feedstock in a delayed, fluid or flexi coker in step (iv).
7. The process of clause 6, wherein the feedstock is introduced into a drum of a delayed coker.
8. The process of any one of clauses 6 or 7, wherein the feedstock is heated to a temperature of at least 450° C.
9. The process of clause 6, wherein the feedstock is introduced into fluidised bed coker reactor.
10. The process of any one of clauses 1 to 9, wherein step (iii) comprises a fractionation step.
11. The process of any one of clauses 1 to 10, further comprising a step of calcining the coke of step (iv) in order to produce a calcined coke.
12. A process for operating a delayed coker comprising performing the process of any one of clauses 1 to 8 in the delayed coker.
13. A process for operating a fluid or flexi coker comprising performing the process of any one of clauses 1 to 6 or clause 9 in the fluid or flexi coker.
14. A coke product obtainable by the process of any one of clauses 1 to 10.
15. The coke product of clause 14, wherein the coke is prepared from a solid-liquid blend that comprises at least around 5% m and at most around 30% m PCP, optionally at least around 10% m and at most around 20% m PCP.
16. The coke product of clauses 14 or 15, wherein the coke is prepared from a solid-liquid blend that comprises a residue oil.
17. The coke product of any one of clauses 14 to 16, wherein the coke is selected from the group consisting of: fuel grade coke; anode grade coke; needle coke; fluid coke; and battery coke.
18. A calcined coke product obtainable by the process of clause 11.
19. A carbon anode comprising the calcined coke product of clause 18.
20. A distillate hydrocarbon liquid product obtainable by the process of any one of clauses 1 to 10.
21. A process for enhancing production of liquid volatile fractions within a delayed, fluid or flexi coker process comprising adding to a liquid oil feed stream a purified coal product (PCP), wherein the PCP is in particulate form, and wherein at least about 90% by volume (% v) of the particles are no greater than about 75 μm in diameter; wherein the PCP has an ash content of less than about 10% m and a water content of less than around 5% m.
22. The process of clause 21, wherein at least about 90% by volume (% v) of the PCP particles are no greater than about 75 μm in diameter; optionally no greater than about 50 μm in diameter.
23. The process of clause 21, wherein at least about 80% by volume (% v) of the PCP particles are no greater than about 20 μm in diameter.
23. The process of clauses 21 or 22, wherein the PCP has an ash content of less than about 2% m, suitably less than about 1.5% m; optionally less than 1% m.
24. The process of clause 23, wherein the PCP has an ash content of less than about 0.9% m.
25. The process of any one of clauses 21 to 24, wherein the PCP has a water content of less than around 2% m.
26. The process of any one of clauses 21 to 25, wherein the liquid oil comprises one or more of the group consisting of: residue from refinery atmospheric distillation of crude oil feedstock; residue from vacuum distillation of crude oil feedstock; slurry oil from catalytic crackers; bottoms from naphtha crackers; oil produced by pyrolysis of plastic, wood and biomass; black liquor from the Kraft process of wood pulp manufacture; light and heavy cycle oil; light and heavy gas oil; diesel fuel; fuel oil; bunker oil; boiler fuel oil; decanted oil; marine fuel oil; marine diesel oil; biodiesel; slop oil; oils derived from tar sands; crude oil; synthetic crude oil; and oil from biofuel manufacture.
27. The use of a purified coal product (PCP), wherein the PCP is in particulate form, and wherein at least about 90% by volume (% v) of the particles are no greater than about 75 μm in diameter; wherein the PCP has an ash content of less than about 10% m and a water content of less than around 5% m, as an additive in a delayed, fluid or flexi coker process in order to increase the proportion of liquid volatile products produced by the process.
28. The use of clause 27, wherein the PCP is added to a residue oil to create a feedstock for delayed, fluid or flexi coker process.
29. The use of clause 28, wherein the residue has not been hydrogenated.
30. The use of any one of clauses 28 to 29, wherein the residue oil comprises one or more of the group consisting of: residue from refinery atmospheric distillation of crude oil feedstock; residue from vacuum distillation of crude oil feedstock; slurry oil from catalytic crackers; bottoms from naphtha crackers; oil produced by pyrolysis of plastic, wood and biomass; black liquor from the Kraft process of wood pulp manufacture; light and heavy cycle oil; light and heavy gas oil; diesel fuel; fuel oil; bunker oil; boiler fuel oil; decanted oil; marine fuel oil; marine diesel oil; biodiesel; slop oil; oils derived from tar sands; crude oil; synthetic crude oil; and oil from biofuel manufacture.

31. The use of any of clauses 27 to 30, wherein the use results in a reduction in the proportion of gaseous volatile products from the delayed coker process.

32. The use of any of clauses 27 to 30, wherein the use results in a conversion of gaseous volatile products from the delayed coker process into liquid volatile products.

Although particular embodiments of the invention have been disclosed herein in detail, this has been done by way of example and for the purposes of illustration only. The aforementioned embodiments are not intended to be limiting with respect to the scope of the invention. It is contemplated by the inventors that various substitutions, alterations, and modifications may be made to the invention without departing from the spirit and scope of the invention.

The invention claimed is:

1. A process for the production of coke and one or more volatile products, the process comprising the steps of:

(i) providing a purified coal product (PCP), wherein the PCP is in particulate form, and wherein at least about 90% by volume (% v) of the particles are no greater than about 100 μm in diameter; wherein the PCP has an ash content of less than about 10 mass % and a water content of less than around 5 mass %;

(ii) combining the PCP with a liquid residue oil in order to create a combined solid-liquid blend, wherein the solid-liquid blend comprises at least around 0.1 mass % and at most around 30 mass % PCP;

(iii) subjecting the solid-liquid blend to a temperature in excess of 375° C. for a time period sufficient to induce cracking of at least 1% of the PCP particles to generate the one or more volatile products, and (iv) producing coke from the product of step (iii), wherein the liquid residue oil comprises one or more of the group consisting of: residue from refinery atmospheric distillation of crude oil feedstock; residue from vacuum distillation of crude oil feedstock; slurry oil from catalytic crackers; bottoms from naphtha crackers; oil produced by pyrolysis of plastic, wood and biomass; black liquor from the Kraft process of wood pulp manufacture; light and heavy cycle oil; light and heavy gas oil; diesel fuel; fuel oil; bunker oil; boiler fuel oil; decanted oil; marine fuel oil; marine diesel oil; biodiesel; slop oil; and oil from biofuel manufacture.

2. The process of claim 1, wherein at least about 90% by volume (% v) of the PCP particles are no greater than about 75 μm in diameter.

3. The process of claim 1, wherein the PCP has an ash content of less than about 2 mass %.

4. The process of claim 1, wherein the PCP has a water content of less than around 2 mass %.

5. The process of claim 1, wherein the solid-liquid blend of (iii) is used as a feedstock in a delayed, fluid or flexi coker in step (iv).

6. The process of claim 5, wherein the feedstock is introduced into a drum of a delayed coker.

7. The process of claim 5, wherein the feedstock is introduced into fluidised bed coker reactor.

8. The process of claim 1, wherein the feedstock is heated to a temperature of at least 450° C.

9. The process of claim 1, wherein step (iii) comprises a fractionation step.

10. The process of claim 1, further comprising a step of calcining the coke of step (iv) in order to produce a calcined coke.

11. A calcined coke product obtainable by the process of claim 10.

12. A process for operating a delayed coker comprising performing the process of claim 1 in a delayed coker.

13. A process for operating a fluid or flexi coker comprising performing the process of claim 1 in a fluid or flexi coker.

14. A coke product obtainable by the process of claim 1.

15. The coke product of claim 14, wherein the coke is prepared from a solid-liquid blend that comprises at least around 5 mass % and at most around 30 mass % PCP.

16. The coke product of claim 14, wherein the coke is prepared from a solid-liquid blend that comprises a residue oil.

17. The coke product of any one of claim 14, wherein the coke is selected from the group consisting of: fuel grade coke; anode grade coke; needle coke; fluid coke; and battery coke.

18. The coke product of claim 14, wherein the coke is prepared from a solid-liquid blend that comprises at least around 10 mass % and at most around 20 mass % PCP.

19. The process of claim 1, wherein the PCP has an ash content not more than 1 mass %.

* * * * *